US010710847B2

(12) United States Patent
Tokutome et al.

(10) Patent No.: US 10,710,847 B2
(45) Date of Patent: Jul. 14, 2020

(54) MOBILE CRANE

(71) Applicant: MAEDA SEISAKUSHO CO., LTD., Nagano-shi, Nagano (JP)

(72) Inventors: Shinya Tokutome, Nagano (JP); Tatsufumi Tomura, Nagano (JP); Ryosuke Nakamura, Nagano (JP); Eiji Ichimura, Nagano (JP); Mitsuaki Wada, Nagano (JP)

(73) Assignee: MAEDA SEISAKUSHO CO., LTD., Nagano-Shi, Nagano (JP)

( * ) Notice: Subject to any disclaimer, the term of this patent is extended or adjusted under 35 U.S.C. 154(b) by 110 days.

(21) Appl. No.: 16/306,338

(22) PCT Filed: Jun. 17, 2016

(86) PCT No.: PCT/JP2016/068042
§ 371 (c)(1),
(2) Date: Nov. 30, 2018

(87) PCT Pub. No.: WO2017/216944
PCT Pub. Date: Dec. 21, 2017

(65) Prior Publication Data

US 2019/0300340 A1 Oct. 3, 2019

(51) Int. Cl.
*B66C 23/70* (2006.01)
*B66C 23/66* (2006.01)

(52) U.S. Cl.
CPC ..... *B66C 23/70* (2013.01); *B66C 23/66* (2013.01); *B66C 2700/0357* (2013.01)

(58) Field of Classification Search
CPC ..... B66C 23/06; B66C 23/36; B66C 23/62; B66C 23/64; B66C 23/66; B66C 23/70;
(Continued)

(56) References Cited

U.S. PATENT DOCUMENTS 4,156,331 A * 5/1979 Lester ..... B66C 23/701 212/349
4,217,987 A * 8/1980 Gattu ..... B66C 23/701 212/299

(Continued)

FOREIGN PATENT DOCUMENTS

JP S60100390 U 7/1985
JP H01547887 A 6/1993

(Continued)

OTHER PUBLICATIONS

International Search Report (PCT/ISA/210) dated Aug. 23, 2016, by the Japanese Patent Office as the International Searching Authority for International Application No. PCT/JP2016/068042.

(Continued)

*Primary Examiner* — Michael R Mansen
*Assistant Examiner* — Juan J Campos, Jr.
(74) *Attorney, Agent, or Firm* — Buchanan Ingersoll & Rooney PC

(57) ABSTRACT

In a crawler crane, while a fly jib is in use, the fly jib is suspended from a coupling flange by a jib raising/lowering wire rope that is wound around a sheave, the sheave being slidably attached to a tip end side section of the fly jib. If the sheave is caused to slide by a jib raising/lowering cylinder attached to the fly jib, the fly jib suspended from the coupling flange by the jib raising/lowering wire rope inclines with respect to a boom. The raising/lowering mechanism of the fly jib is installed on the fly jib side, thus making it possible to easily perform work to extract/store the fly jib.

5 Claims, 6 Drawing Sheets

(58) Field of Classification Search
CPC ..... B66C 23/701; B66C 23/702; B66C 13/18; B66C 13/22
See application file for complete search history.

(56) References Cited

U.S. PATENT DOCUMENTS

| | | | | |
|---|---|---|---|---|
| RE30,905 | E * | 4/1982 | Lester | B66C 23/701 212/349 |
| 6,036,035 | A | 3/2000 | Asano et al. | |
| 2017/0305726 | A1* | 10/2017 | Harauchi | B66C 23/70 |
| 2018/0037446 | A1* | 2/2018 | Harauchi | B66C 23/66 |
| 2018/0118527 | A1* | 5/2018 | Harauchi | B66C 23/68 |

FOREIGN PATENT DOCUMENTS

| | | | |
|---|---|---|---|
| JP | 2883860 | B2 | 4/1999 |
| JP | 2000086162 | A | 3/2000 |
| JP | 2002241081 | A | 8/2002 |
| JP | 2011131975 | A | 7/2011 |
| JP | 2014208525 | A | 11/2014 |
| JP | 2015040107 | A | 3/2015 |

OTHER PUBLICATIONS

Written Opinion (PCT/ISA/237) dated Aug. 23, 2016, by the Japanese Patent Office as the International Searching Authority for International Application No. PCT/JP2016/068042.

* cited by examiner

MOBILE CRANE

TECHNICAL FIELD

The present invention relates to a crawler crane, a track crane, or another mobile crane, and particularly relates to a mobile crane provided with a fly jib (auxiliary jib) that is attached to a tip end of a boom for use.

BACKGROUND ART

One known example of a mobile crane is one structured such that a fly jib is removably attached to a tip end of a boom for use, in order to expand the range of work that can be performed by the boom. The fly jib is stored on the boom in a state of extending along a side surface, lower surface, etc., of the boom, the boom being mounted on an upper turning body so that it can be raised and lowered.

When crane work is performed using a fly jib, the fly jib is attached in a state of extending frontward of the boom from a tip end part of the final-stage movable boom of the boom. Additionally, a raising/lowering rope for raising and lowering the fly jib, with the boom tip end part as a fulcrum, is stretched from the same side as the boom to the fly jib side, otherwise a fly jib raising/lowering cylinder is stretched between the boom and the fly jib.

Patent Document 1 proposes a mobile crane in which a fly jib is raised and lowered using a raising/lowering wire rope. Patent Document 2 proposes a jib raising/lowering device for a crane in which a fly jib is raised and lowered using a raising/lowering cylinder. In extracted work in which the fly jib is switched from a stored state to an extracted state, and also in storing work, a raising/lowering rope or a raising/lowering cylinder must be stretched between the boom and the fly jib, which is labor-intensive.

Various instruments are installed on the fly jib in order to detect an angle of inclination, an exerted load, length, a wound-up state of an auxiliary hook suspended from the fly jib, etc. Signal lines and power supply lines led out from the boom side are connected to the instruments installed on the fly jib. In the work of extracting/storing the fly jib, work must be performed to guide and connect/disconnect numerous wires, which is troublesome. Additionally, there are cases in which the numerous wires cannot be appropriately guided to the fly jib, which is smaller in cross-section than the boom. Furthermore, in the case of numerous cables, the cable diameter is greater and the reel is larger as well.

Patent Document 3 proposes a cable winding device that uses a multi-core conductive cable suitable for placement in a telescopic boom, which is an extendable/retractable multi-stage boom. Patent Document 4 proposes a communication system in which, in construction machinery, a driver-cabin-side control device and unit-side control devices disposed on the left and right of an upper turning body are connected by a CAN communication line. However, in the prior art, there has been no focus on efficiently performing the work of connecting/disconnecting the numerous signal lines and power supply lines stretched between the fly jib and the boom in the work of extracting/storing the fly jib.

PRIOR ART DOCUMENTS

Patent Documents

Patent Document 1: JP-A 2011-131975
Patent Document 2: JP-B 2883860
Patent Document 3: JP-A 2015-40107
Patent Document 4: JP-A 2014-208525

SUMMARY OF THE INVENTION

Problems to be Solved by the Invention

An object of the present invention, in view of such matters, is to provide a mobile crane in which the work of extracting/storing a fly jib can be performed efficiently in a simple manner.

Means of Solving the Problems

In order to solve the abovementioned problems, the mobile crane of the present invention is characterized by including:

a fly jib;

a jib coupling member that is coupled to a rear end of the fly jib and removably attached to a tip end part of the boom in order to couple the fly jib to the tip end part of the boom such that the fly jib can be raised and lowered with the rear end thereof as a fulcrum;

a sheave disposed in a distal-end-side area of the fly jib so as to be capable of sliding in a longitudinal direction of the fly jib;

a raising/lowering cylinder for sliding the sheave in the longitudinal direction; and a raising/lowering wire rope which is stretched between the jib coupling member and an area of the fly jib that is rearward from the sheave in the longitudinal direction, a wire rope portion partway along the raising/lowering wire rope being wound around the sheave from a front side of the fly jib.

When the fly jib is used, the jib coupling member coupled to the rear end of the fly jib is attached to the tip end part of the boom, and the fly jib is placed in a state of extending forward from the tip end part of the boom. When the jib raising/lowering wire rope is stretched from the jib coupling member to the fly jib via the sheave and the jib raising/lowering cylinder is brought to a predetermined extended state, the fly jib is held in a fixed orientation by the jib raising/lowering wire rope. When the jib raising/lowering cylinder is retracted from this state, the sheave to which the jib raising/lowering wire rope is stretched moves to the rear end side of the fly jib and the jib raising/lowering wire rope slackens. The weight of the fly jib joined to the jib raising/lowering wire rope causes the fly jib to be in a downward orientation of having turned downward, commensurately with respect to the degree in which the jib raising/lowering wire rope is slackened, about a fulcrum defined by the jib coupling member.

The amount of slackness in the jib raising/lowering wire rope stretched to the sheave is approximately twice the amount that the sheave slides. Therefore, in comparison with a case in which the wire rope joined at one end to the fly jib is directly unwound to cause the fly jib to be inclined downward, the stroke of the raising/lowering cylinder needed to incline the fly jib at the same angle need only be half of the unwound amount of the wire rope.

The jib raising/lowering cylinder is attached to the fly jib, and the jib raising/lowering wire is stretched between the fly jib and the jib coupling member coupled to the rear end of the fly jib. Therefore, in comparison with a case in which the jib raising/lowering wire rope or the jib raising/lowering cylinder is attached between the fly jib and the boom when the fly jib is extracted and is taken out of this space when the fly jib is stored, the work of extracting/storing the fly jib can be performed efficiently and in a simple manner.

When the fly jib is an extendable/retractable jib, a jib extending/retracting cylinder for extending and retracting the fly jib is installed on the fly jib.

Also installed on the fly jib are at least the following: instruments including an angle of inclination detector that detects the angle of inclination of the fly jib and a load detector that detects the load exerted on the fly jib; a hydraulic pressure pipe that supplies hydraulic pressure to the raising/lowering cylinder and the extending/retracting cylinder; a select valve that switches the destination to which hydraulic pressure is supplied via the hydraulic pressure pipe; and a fly-jib-side controller that receives information pertaining to the angle of inclination and the load from the angle of inclination detector and the load detector, and controls the switching of the select valve.

In this case, the fly-jib-side controller is preferably designed to communicate through controller area network (CAN) protocol with a main-body-side controller disposed in either an upper turning body on which the boom is installed or a lower traveling body on which the upper turning body is installed. Another option is communication through Ethernet (®), which is commonly used as a LAN.

What is used is, for example, a four-core cable for a CAN communication line wound around a cord reel attached to the boom, and a cable connector disposed on the same side as the fly-jib-side controller for connecting the four-core cable unwound from the cord reel.

By using a CAN communication line to connect the fly jib side and the main body side, the number of wires between these sides can be reduced. The work of extracting/storing the fly jib can thereby be performed efficiently and in a simple manner.

In this aspect of the invention, when the main-body-side controller is provided with a main controller disposed in the driver seat installed in the lower traveling body and a turning-body-side controller disposed in the upper turning body, the main controller and the turning-body-side controller can also be connected by a CAN communication line via a slip ring. In this case, the turning-body-side controller and the fly-jib-side controller are connected via a four-core cable for the CAN communication line.

MODE FOR CARRYING OUT THE INVENTION

An embodiment of a mobile crane to which the present invention is applied is described below with reference to the drawings. The embodiment described below is one example in which the present invention is applied to a crawler crane. The present invention can be similarly applied to a track crane, a wheel crane, and other mobile cranes.

(Overall Configuration)

Figure 1A:
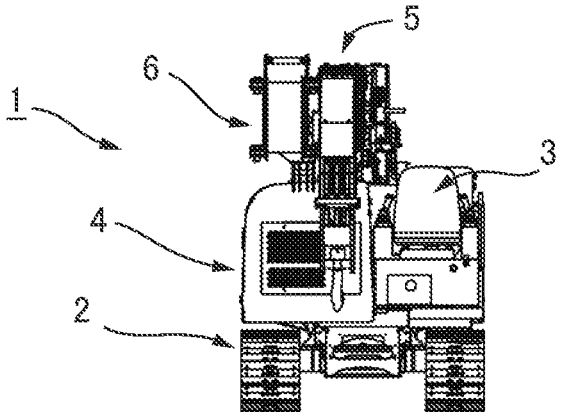
FIGS. 1(*a*)-1(*c*) include a front view, side view, and plan view showing a crawler crane according to an embodiment of the present invention.
Figure 1B:
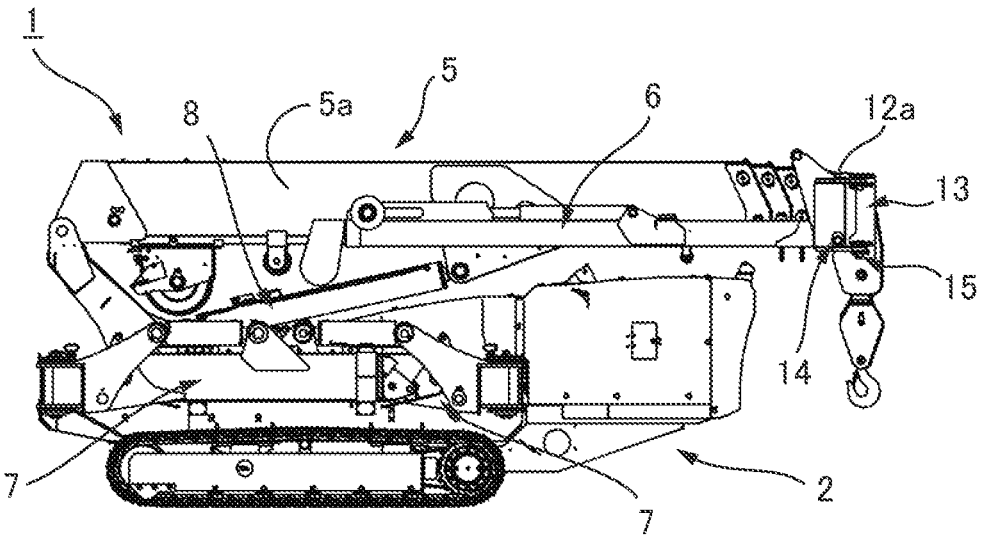
Figure 1C:
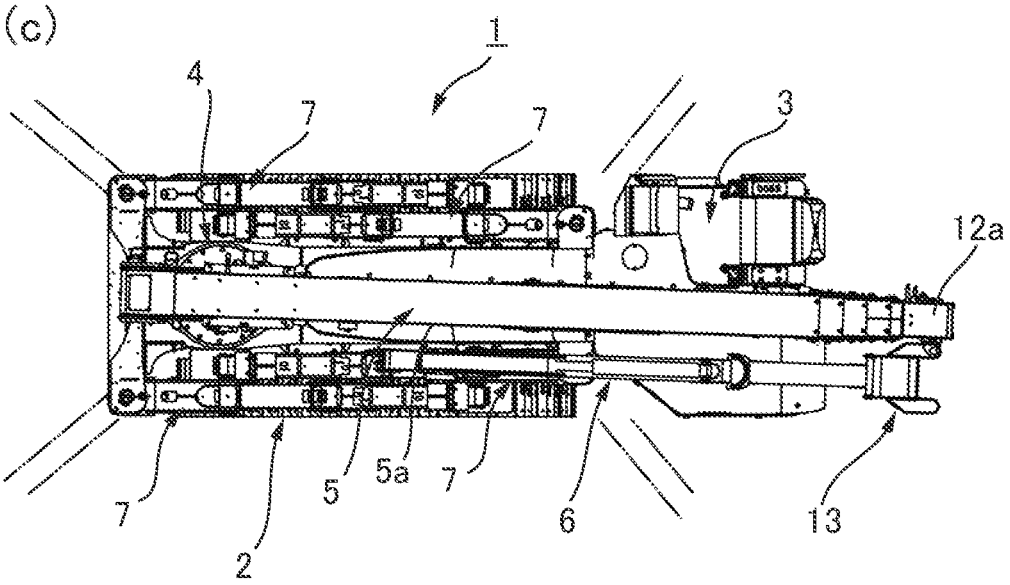
Figure 2:
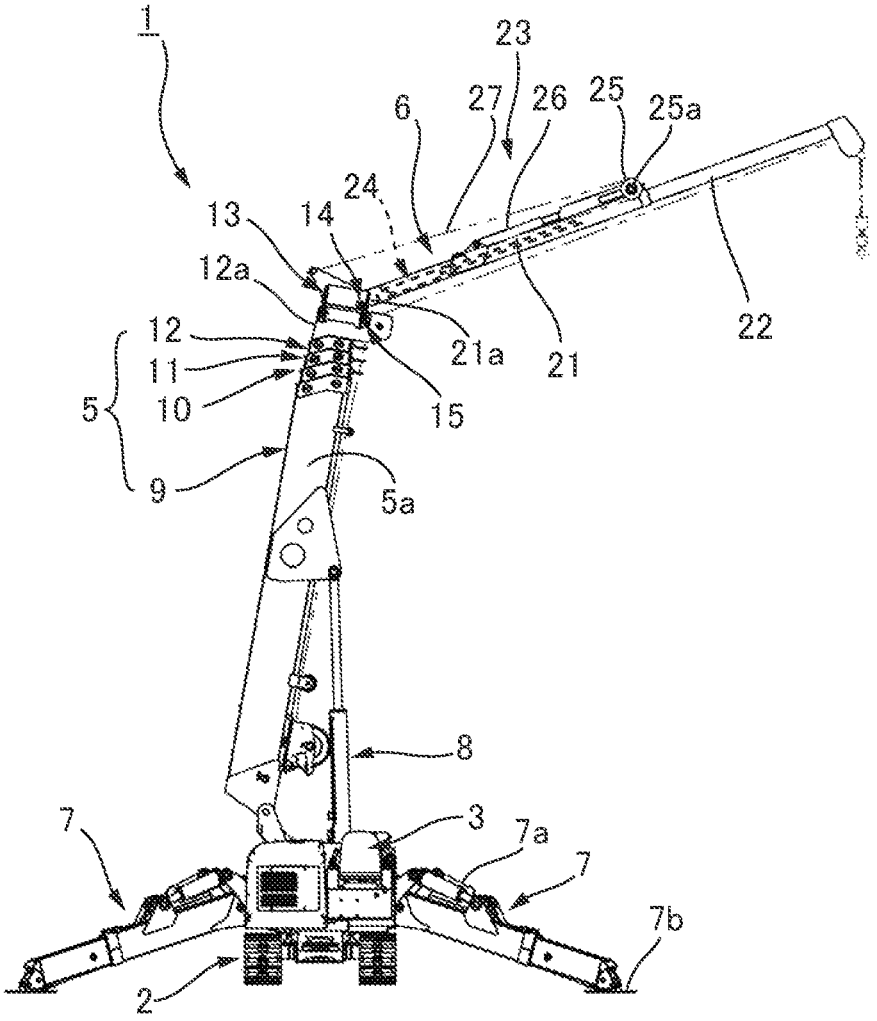
FIG. 2 is a front view showing an example of a working state using a fly jib in the crawler crane.

FIG. 1(*a*) is a front view showing a crawler crane according to the present embodiment, FIG. 1(*b*) is a side view of the same, and FIG. 1(*c*) is a plan view of the same. FIG. 2 is a front view showing an example of a working state using a fly jib.

A crawler crane 1 is provided with a crawler-type lower traveling body 2, a driver seat 3 placed on the left side of the frontal section of the lower traveling body 2, an upper turning body 4 installed in the center of the rear section of the lower traveling body 2, a multi-stage boom 5 installed on the upper turning body 4, and a fly jib 6 stored on a side surface of the boom 5.

Outriggers 7 are attached to the four corners of the lower traveling body 2. The four outriggers 7 are capable of turning about vertical axis lines centered about the inner ends of the outriggers, as shown by the imaginary lines in FIG. 1(*c*). With any one outrigger 7 in an outward protruding state, a state can be brought about in which a grounding plate 7*b* at the tip end is grounded by a hydraulic cylinder 7*a* as shown in FIG. 2, and in this state, when the outrigger is extended in the length direction, a state can be brought about in which the crawler of the lower traveling body 2 rises upward. The crawler crane 1 can be installed so as to be stable in a predetermined work position by the four outriggers.

The upper turning body 4 is capable of turning about a vertical axis, and a boom raising/lowering cylinder 8 bridges between the upper turning body 4 and a first-stage stationary boom 9 of the boom 5. A plurality of movable booms, e.g., three movable booms 10, 11, 12, are stored in the stationary boom 9, and these movable booms can be extended and retracted by an internally provided boom extending/retracting cylinder, boom extending/retracting wire rope, or other mechanism.

The fly jib 6 is stored so as to extend along the side surface of the boom 5. The rear end part of the fly jib 6 is coupled to a coupling flange 13 so as to be capable of vertically rising and falling, the fulcrum for which is a horizontal coupling pin 14 attached to the coupling flange 13 (jib-coupling member). The coupling flange 13 is removably coupled to a tip end part 12*a* of the final-stage movable boom 12 of the boom 5. Additionally, the coupling flange 13 is capable of turning about a vertical coupling pin 15 in relation to the tip end part 12*a* of the movable boom 12, from a side surface 5*a* of the boom 5 to a position where the coupling flange faces toward the tip end surface.

In unloading work involving use of the fly jib 6, etc., the fly jib 6 and the coupling flange 13 are caused to turn outward to the side from the side surface 5*a* of the boom 5 about the vertical coupling pin 15, and a switch is made to a state in which the fly jib 6 protrudes toward the front of the boom from the tip end of the boom 5. In this state, the coupling flange 13 is fixedly coupled by a coupling pin (not shown) to the tip end part 12*a* of the movable boom 12 so as to not turn.

The fly jib 6, as shown in FIG. 2, is provided with a fixed-side jib 21 that can be raised and lowered, the fulcrum being the horizontal coupling pin 14 of the coupling flange 13 attached to the tip end part 12*a* of the movable boom 12, and a movable-side jib 22 mounted to the jib 21 so as to be able to protrude from the tip end of the jib 21. Additionally, a jib raising/lowering device 23 and a jib extending/retracting device 24 are disposed on the fly jib 6. The fly jib 6 can raised and lowered by the jib raising/lowering device 23 in relation to the boom 5, from an initial orientation of extending in the length direction and an inclined orientation of being inclined downward at a predetermined angle. The movable-side jib 22 of the fly jib 6 can be extended by the jib extending/retracting device 24 from a stored position of having withdrawn into the fixed-side jib 21 to an extended position shown by the solid lines.

(Jib Raising/Lowering Device·Jib Extending/Retracting Device)

Figure 3A:
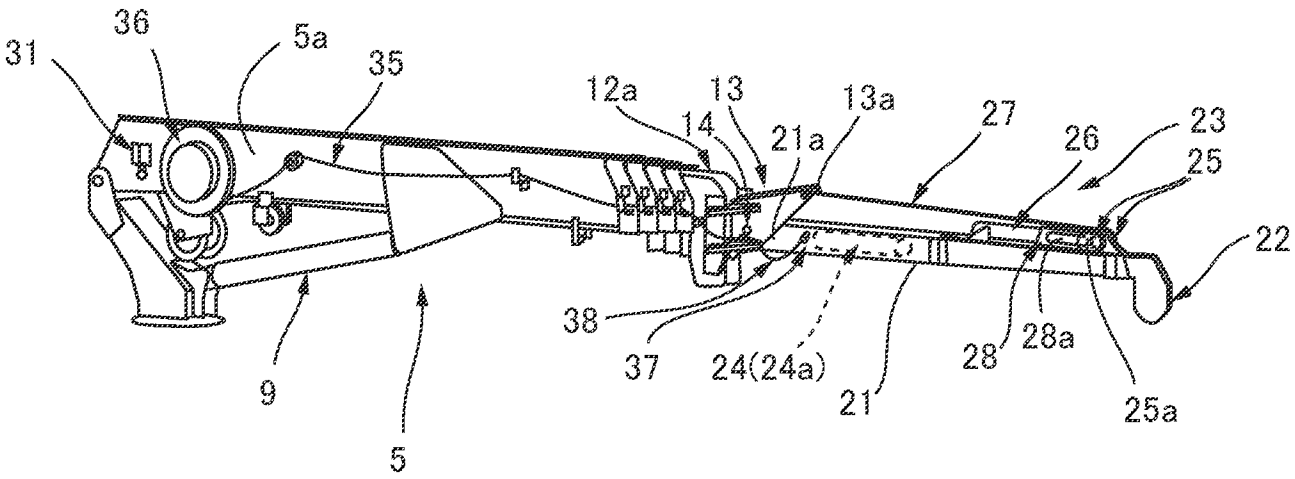
FIGS. 3(*a*) and 3(*b*) are explanatory drawings showing a jib raising/lowering device·jib extending/retracting device and a hydraulic circuit.
Figure 3B:
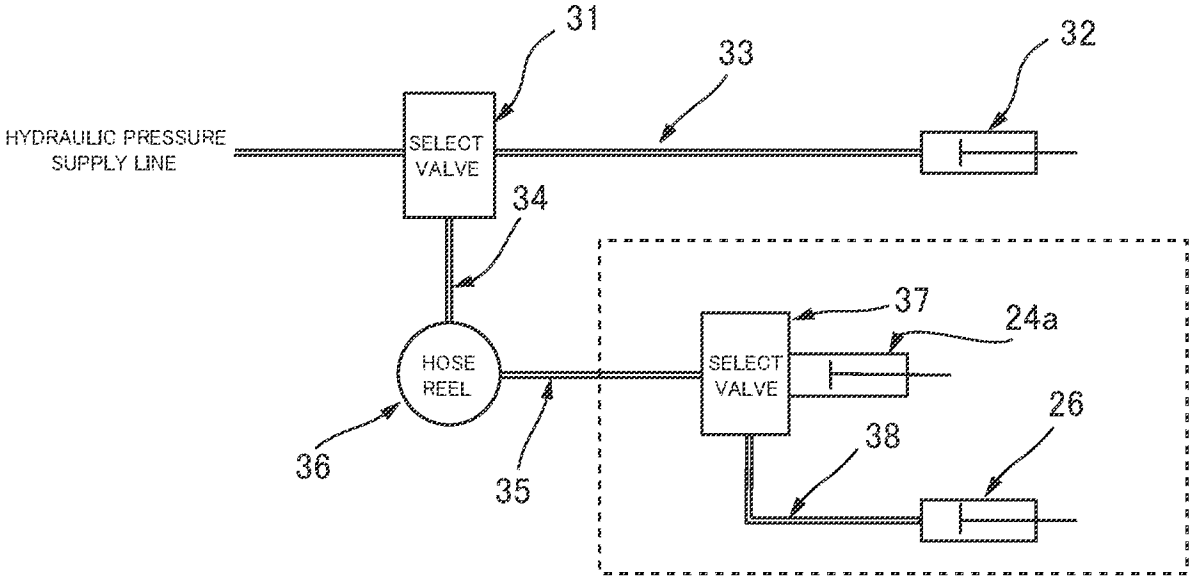

FIG. 3(*a*) is an explanatory drawing showing the jib raising/lowering device 23 and the jib extending/retracting device 24 attached to the fly jib 6, and FIG. 3(*b*) is an explanatory drawing showing hydraulic circuitry for these devices. The jib raising/lowering device 23 is provided with the coupling flange 13, a pair of sheaves 25, jib raising/lowering cylinders 26, and jib raising/lowering wire ropes 27. The jib extending/retracting device 24 is provided with a jib extending/retracting cylinder 24*a* housed within the rear section of the fixed-side jib 21.

In the jib raising/lowering device 23, the coupling flange 13 supports a rear end part 21*a* of the fixed-side jib 21 so that the fly jib 6 can be raised and lowered with the horizontal coupling pin 14 as a fulcrum, as previously described.

The sheaves 25 are attached to the tip ends of the jib raising/lowering cylinders 26, and are capable of sliding in the longitudinal direction of the fly jib 6 (the jib length direction) in the region at the tip end side of the fly jib 6. In the present example, center shafts 25*a* of the pair of sheaves 25 are passed in a slidable state through slide grooves 28*a* of fixed width, which extend lengthwise in the longitudinal direction and which are formed in left and right brackets 28 attached to the fly jib 6.

The jib raising/lowering cylinders 26 are disposed on the upper surface of the fixed-side jib 21, along the length direction thereof. The rear ends of the jib raising/lowering cylinders 26 are fixed to the fixed-side jib 21, and extending/retracting ends on the tip-end sides of the cylinders are coupled to the center shafts 25*a* of the sheaves 25. When the jib raising/lowering cylinders 26 are extended or retracted, the sheaves 25 coupled thereto slide along the slide grooves 28*a* at a predetermined stroke in the longitudinal direction of the fly jib 6.

One wire rope end of each of the jib raising/lowering wire ropes 27 is fixedly coupled to an upper end part 13*a* of the coupling flange 13, and the other wire rope end is fixedly coupled to an area of the fixed-side jib 21 partway along the length direction. These jib raising/lowering wire ropes 27 are, at some point partway along the wire ropes, wound around the left and right sheaves 25 from the tip-end side of the jib, and the wire rope ends on both sides extend to the rear of the sheaves.

When the fly jib 6 is attached in a state of extending forward from the tip end part 12*a* of the boom 5 and is switched to a state of being able to be raised and lowered with the horizontal coupling pin 14 of the coupling flange 13 as a fulcrum, the fly jib 6 is held by the jib raising/lowering wire ropes 27, and the jib raising/lowering wire ropes 27 come to be in a state of tension. For example, when the jib raising/lowering cylinders 26 are in the farthest extended state, the lengths of the jib raising/lowering wire ropes 27 are set so that the fly jib 6 is in an orientation of extending from the tip-end side of the boom 5 in a straight line in the length direction thereof, as shown in FIG. 3(*a*).

In this embodiment, the jib raising/lowering cylinders 26 and the jib extending/retracting cylinder 24*a* are hydraulic cylinders, and hydraulic pressure is supplied from a side where a hydraulic pressure source (hydraulic pump) (not shown) is present, this source being installed on the side where the lower traveling body 2 is present. As shown in FIGS. 3(*a*) and (*b*), working hydraulic pressure is supplied from the hydraulic pressure source, via an electromagnetic select valve 31 attached to the side surface 5*a* of the boom 5, to hydraulic hoses 33, 34 that supply hydraulic pressure toward a boom extending cylinder 32 and the fly jib 6. A hydraulic hose 35 leading toward the fly jib 6 is wound around a hose reel 36 attached to the side surface at the rear-end side of the boom 5, and the hydraulic hose 35 can be unwound from this hose reel 36. The hydraulic hose 35 is extracted from the tip end of the boom 5, and can be connected to an electromagnetic select valve 37 attached to the side surface of the rear end part of the fly jib 6. Hydraulic pressure is supplied to the jib extending/retracting cylinder 24*a* via the select valve 37, and is supplied to the jib raising/lowering cylinders 26 via the select valve 37 and a hydraulic hose 38.

Figure 4A:
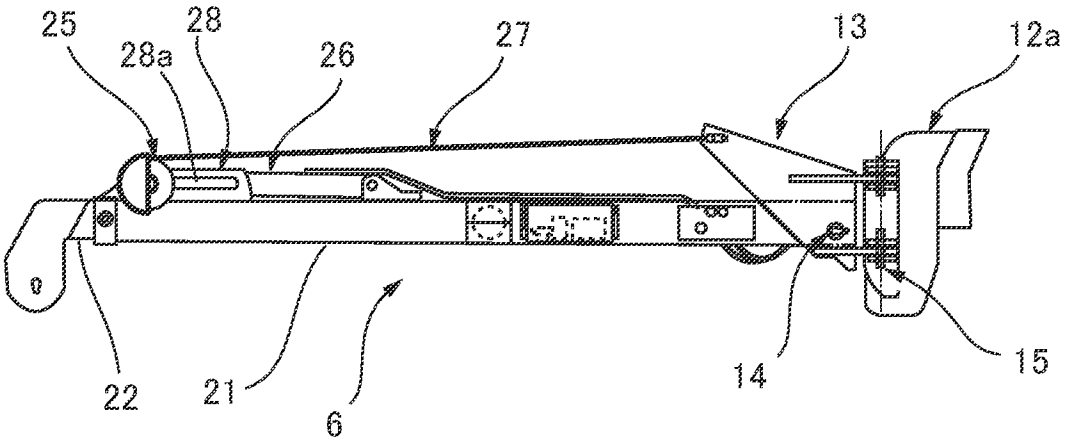
FIGS. 4(*a*) and 4(*b*) include explanatory drawings showing the actions of raising and lowering the fly jib.
Figure 4B:
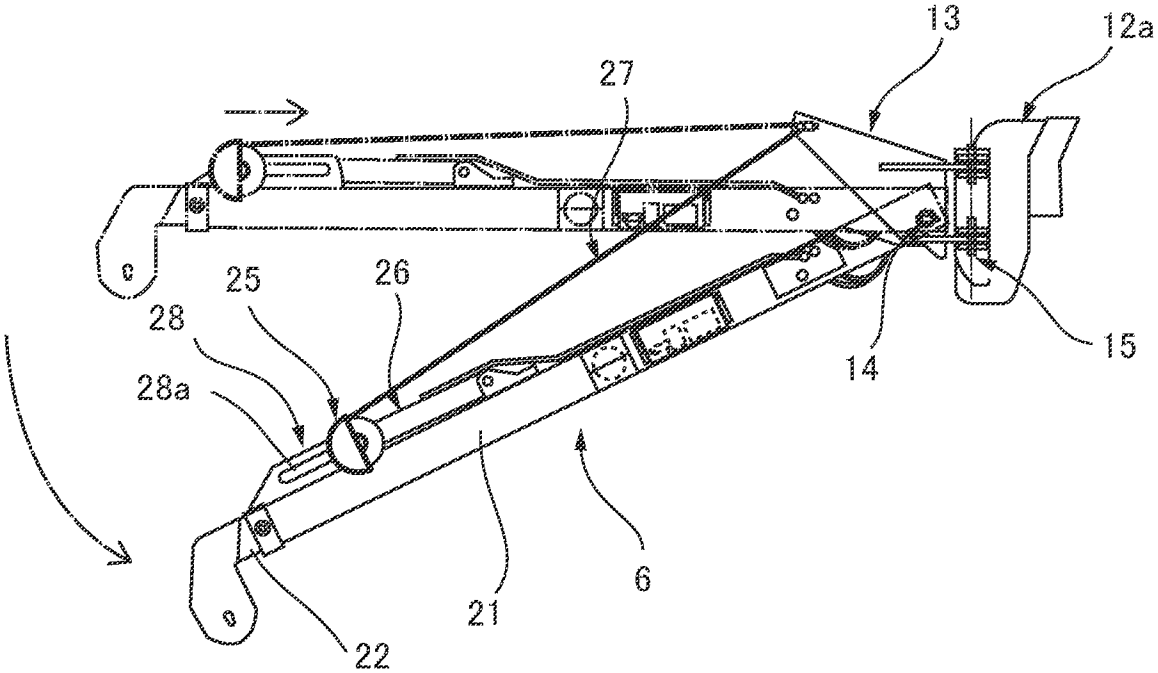

FIG. 4 is an explanatory drawing showing the action in which the fly jib 6 is raised and lowered by the jib raising/lowering device 23. In the initial state shown in FIG. 4(*a*), the jib raising/lowering cylinders 26 are in the farthest extended state. In this state, the fly jib 6 is held in an orientation of extending from the tip end part 12*a* of the boom 5 in the length direction thereof. When the jib raising/lowering cylinders 26 are retracted from this state, the left and right sheaves 25 slide along the slide grooves 28*a* to the rear-end side of the fly jib 6 along with the retraction.

As shown in FIG. 4(*b*), when the sheaves 25 slide to the rear ends of the slide grooves 28*a*, the weight of the fly jib 6 causes the fly jib to, along with the sliding action, turn downward about the horizontal coupling pin 14 of the coupling flange 13. The fly jib 6 thereby comes to be in an inclined orientation of being inclined downward relative to the boom 5 (see FIG. 2).

Because the jib raising/lowering wire ropes 27 slacken to a length approximately twice the retracted amount of the jib raising/lowering cylinders 26, the weight of the fly jib 6 causes the fly jib to turn downward by the same length. Consequently, the fly jib 6 can be inclined by driving the jib raising/lowering cylinders 26 with a small stroke than in a case in which jib raising/lowering wire ropes attached to the fly jib 6 are directly unwound by a winch, etc.

Thus, the fly jib 6 is suspended from the coupling flange 13 by the jib raising/lowering wire ropes 27 wound around the sheaves 25, which are slidably attached to the distal-end-side area of the fly jib 6. When the sheaves 25 are slid by the jib raising/lowering cylinders 26 attached to the fly jib 6, the fly jib 6 suspended from the coupling flange 13 by the jib raising/lowering wires 27 is inclined relative to the boom 5. Because the mechanism for raising and lowering the fly jib 6 is installed on the same side as the fly jib, the work of extracting/storing the fly jib can be performed in a simple manner.

(Fly Jib CAN Communication System)

Figure 5:
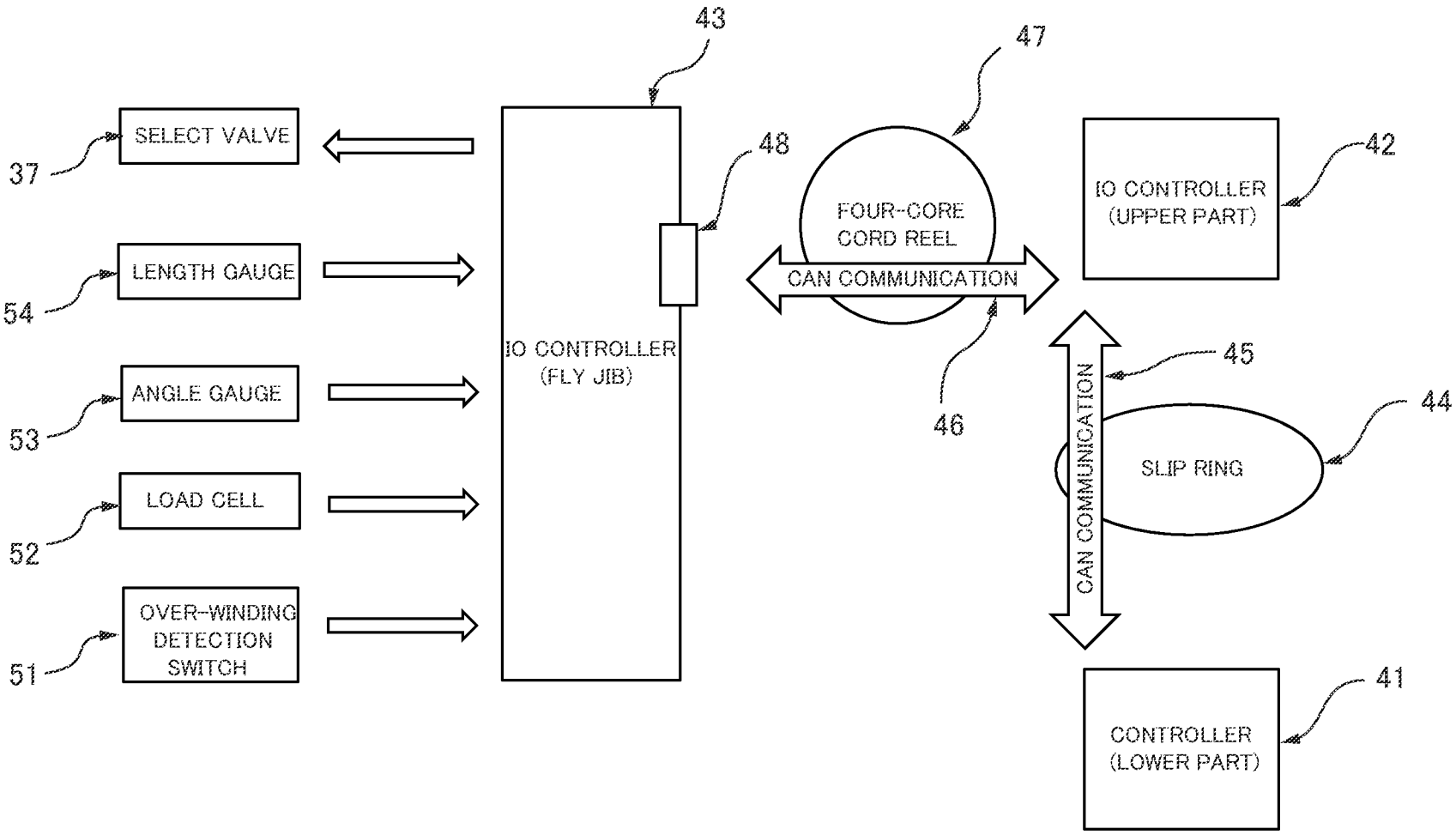
FIG. 5 is a schematic block diagram of the control system of the crawler crane.

Next, FIG. 5 is a schematic block diagram showing the control system of the crawler crane 1. As shown in this diagram, the control system is provided with a controller 41 disposed in the driver seat 3 of the lower traveling body 2, a turning-body-side I/O controller 42 disposed in the upper turning body 4, and a fly-jib-side I/O controller 43 disposed in the fly jib 6. The controller 41, which is a main-body-side controller, and the turning-body-side I/O controller 42 are connected by a CAN communication line 45 via a slip ring 44.

The turning-body-side I/O controller 42 and the fly-jib-side I/O controller 43 are also connected via a four-core cable 46, which is a CAN communication line, and signals are sent and received between these controllers by CAN communication. The four-core cable 46 is wound around a cord reel 47 attached to the same side as the boom 5, and the cable is unwound from this reel and removably connected to a cable connector 48 disposed on the same side as the fly-jib-side I/O controller 43.

Instruments for detecting the working state of the fly jib 6 are connected to the fly-jib-side I/O controller 43. Examples of connected instruments include an over-winding detection switch 51 that detects an over-wound state of an auxiliary wire hanging from the fly jib 6, a load cell 52 that measures the load exerted on the fly jib 6, an angle gauge 53 that detects the angle of inclination of the fly jib 6, a length gauge 54 that measures the length of the fly jib 6, etc. Additionally, the fly-jib-side I/O controller 43 is connected to the select valve 37 via a signal line.

The fly-jib-side I/O controller 43 converts input values from these instruments, and through CAN communication, transmits these values to the traveling-body-side controller 41 via the turning-body-side I/O controller 42. Control signals, etc., from the controller 41 and the turning-body-side I/O controller 42 are transmitted through CAN communication to the fly-jib-side I/O controller 43. The I/O controller 43 performs switching control for the select valve 37 on the basis of a received control signal.

Figure 6:
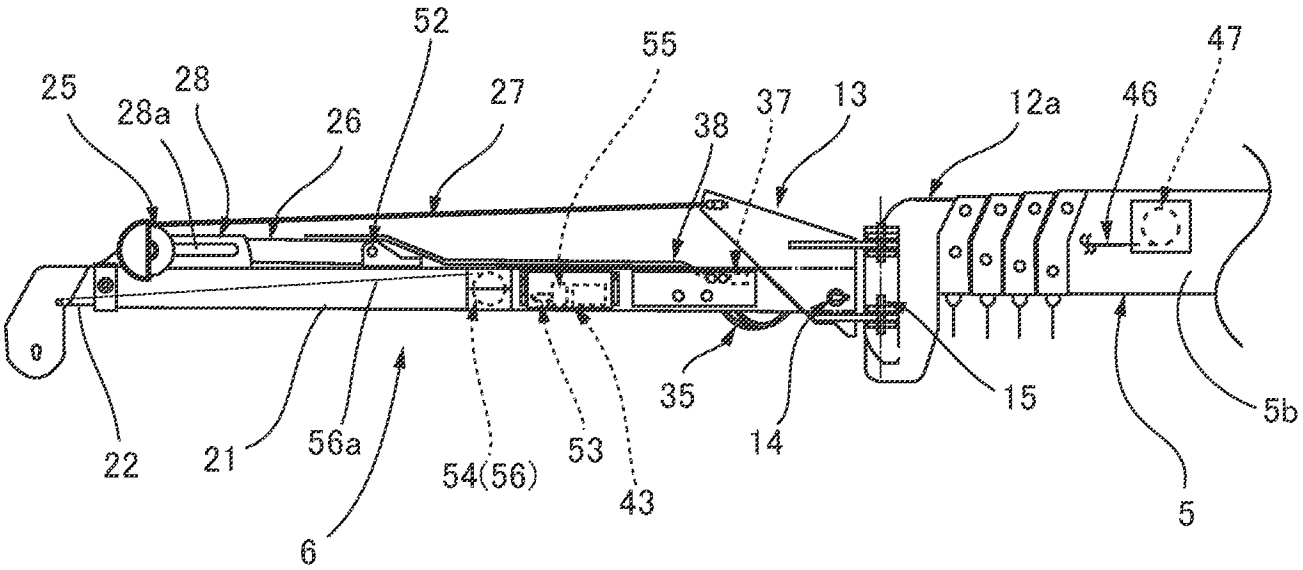
FIG. 6 is an explanatory drawing showing an example of the positions where instruments, etc., of the fly jib are attached.

FIG. 6 is an explanatory drawing showing examples of positions where the instruments, etc., disposed on the fly jib 6 are attached. In the example of this drawing, the fly-jib-side I/O controller 43 is incorporated in a section partway along the length direction in the side surface of the fly jib 6. The angle gauge 53 is incorporated in this location. Additionally, a load cell amplifier 55, a signal processing circuit, a communication circuit, etc., are installed.

At a position forward in the jib length direction from the fly-jib-side I/O controller 43, a cord reel 56 for the length gauge 54 is attached, and from this reel a length measurement cord 56*a* is unwound and joined to the tip end of the movable-side jib 22. Additionally, a pin-type load cell is incorporated as the load cell 52 in the position where the fly jib 6 is attached in the rear ends of the jib raising/lowering cylinders 26.

The cord reel 47, around which the four-core cable 46 for the CAN communication line is wound, is attached to a side surface 5*b* on the tip-end side of the boom 5. During work involving use of the fly jib 6, the four-core cable 46 unwound from the cord reel 47 is connected to the fly-jib-side I/O controller 43, and a communication line with the main-body side is established. Because it is sufficient to create only one wire connection, the work of extracting/storing the fly jib 6 can be performed in a simple manner and in a short time.

The select valve 37 is attached to an area that is rearward in the jib length direction from the fly-jib-side I/O controller 43. Components including the select valve 37 and the hydraulic hose 38, etc., extend to the jib raising/lowering cylinders 26, etc. Additionally, the hydraulic hose 35 extracted from the same side as the boom 5, which is the upstream side, is connected to the select valve 37. The hydraulic hose 35 is unwound from the hose reel 36 attached to the side surface on the side opposite from the boom 5, as shown in FIG. 3(*a*).

These elements such as the positions in the fly jib 6 where the instruments are attached are intended to demonstrate one example; the present invention is not limited to the structures of the above embodiment.

The invention claimed is:

1. A mobile crane, comprising:

a fly jib;

a jib coupling member that is coupled to a rear end of the fly jib and removably attached to a tip end part of the boom in order to couple the fly jib to the tip end part of the boom such that the fly jib can be raised and lowered with the rear end thereof as a fulcrum;

a sheave disposed in a distal-end-side area of the fly jib so as to be capable of sliding in a longitudinal direction of the fly jib;

a raising/lowering cylinder for sliding the sheave in the longitudinal direction; and a raising/lowering wire rope stretched between the jib coupling member and an area of the fly jib that is rearward from the sheave in the longitudinal direction, a wire rope portion partway along the raising/lowering wire rope being wound around the sheave from a front side of the fly jib.

2. The mobile crane according to claim 1, wherein the fly jib is an extendable/retractable jib, and the fly jib is provided with a jib extending/retracting cylinder for extending and retracting the fly jib.

3. The mobile crane according to claim 1, further comprising:

a fly-jib-side controller installed on the fly jib for controlling operations of the fly jib, and the fly-jib-side controller communicates through either one of controller area network (CAN) protocol and Ethernet (®), with a main-body-side controller disposed in either an upper turning body on which the boom is installed or a lower traveling body on which the upper turning body is installed.

4. The mobile crane according to claim 3, wherein the fly-jib-side controller communicates through the controller area network (CAN) protocol with the main-body-side controller, and the mobile crane further comprising:

a four-core cable for a CAN communication line, the four-core cable being wound around a cord reel attached to the boom; and a cable connector for connecting the four-core cable unwound from the cord reel, the cable connector being disposed at a side of the fly-jib-side controller.

5. The mobile crane according to claim 4, wherein the main-body-side controller is provided with a main controller disposed in a driver seat installed in the lower traveling body and a turning-body-side controller disposed in the upper turning body;

the main controller and the turning-body-side controller are connected by the CAN communication line via a slip ring; and the turning-body-side controller and the fly-jib-side controller are connected via the four-core cable for the CAN communication line.

* * * * *